United States Patent [19]

Kostyanoi et al.

[11] 4,165,234

[45] Aug. 21, 1979

[54] PROCESS FOR PRODUCING FERROVANADIUM ALLOYS

[76] Inventors: Boris M. Kostyanoi, ulitsa Kutuzova, 104-a, kv. 39; Anatoly I. Manokhin, ulitsa Metallurgov, 4, kv. 44; Alexei G. Zubarev, ulitsa Pervomaiskaya, 11, kv. 50; Gennady S. Kolganov, ulitsa Kalinina, 26, korpus 2, kv. 307; Stanislav S. Volkov, ulitsa Volodarskogo, 78, korpus 1, kv. 116; Igor A. Taldykin, Dovatora, 12, kv. 2; Viktor V. Kazansky, 2 prospekt Metallurgov, 5, kv. 29; Evgeny N. Ivashina, ulitsa Kirova, 18/141, kv. 42, all of Tula, U.S.S.R.

[21] Appl. No.: 886,923

[22] Filed: Mar. 14, 1978

[51] Int. Cl.[2] ..... C22C 33/00; C22C 33/04

[52] U.S. Cl. ..... 75/60; 75/52; 75/129; 75/133.5

[58] Field of Search ..... 75/60, 52, 129, 133.5

[56] References Cited

U.S. PATENT DOCUMENTS 4,071,355 1/1978 Staggers ..... 75/60

*Primary Examiner*—P. D. Rosenberg

*Attorney, Agent, or Firm*—Steinberg & Blake

[57] ABSTRACT

The process according to the present invention relates to the production of ferrovanadium alloys. The process comprises melting a charge containing iron and vanadium with a subsequent reduction of iron and vanadium to give a metal melt. In accordance with the present invention, iron and vanadium are reduced substantially completely. The resulting metal melt is poured into a converter and then purged, through the converter bottom, by means of oxygen blowing at a supply rate of oxygen and for a period of time sufficient to produce a slag containing at least 35% by weight of vanadium pentoxide. Thereafter, the metal melt is discharged from the converter, while vanadium and iron are reduced from the resulting slag by the metallothermal method.

1 Claim, No Drawings

PROCESS FOR PRODUCING FERROVANADIUM ALLOYS

The present invention relates to ferrous metallurgy and, more specifically, to a process for producing ferrovanadium alloys.

The present invention is useful in the production of ferrovanadium alloys from a vanadium-containing slag.

The present invention may also be used in ferrous metallurgy for the production of alloys containing such elements as silicon, manganese, chromium and the like, which may be used for alloying of steel.

Known in the art is a process for producing ferrovanadium alloys from a charge containing vanadium and iron. As the charge use is made of a slag containing vanadium and iron in the form of oxides. This slag is usually produced by purging of molten vanadium-containing iron in a converter.

This slag is mixed with coke and fluorspar and charged into an electric furnace, wherein this mixture is heated to such a temperature that the slag and fluorspar are melted. The resulting slag melt is maintained at a temperature within the range of from 1,400° to 1,450° C. After melting of the slag, a portion of iron oxides and vanadium oxides is reduced by reacting the same with carbon contained in the coke and with silicon and aluminium which are doped, i.e. added into the slag melt.

As a result of reduction, the content of iron oxides is considerably lowered along with a lowered, though to a lesser extent, content of vanadium oxides in the slag melt.

When the content of iron oxides in the slag melt is equal to 10% by weight, this melt with the reduced metals, i.e. iron and vanadium, is cast into casting molds. After cooling in the casting molds, the slag is separated from the reduced metals and recharged into the electric furnace.

In the electric furnace the slag is again melted and iron and vanadium are then totally reduced in the form of a ferrovanadium alloy by adding silicon and aluminium.

The main disadvantage of this prior art process resides in considerable losses of vanadium. This is due to the fact that not only iron, but vanadium as well, though to a lesser extent, is reduced from the slag melt upon reaching the content of iron oxides of 10% by weight. For this reason, a metal melt is cast into molds with the content of vanadium of generally about 3% by weight, which is further used as iron scrap, which is undesirable, since it results in a reduced content of vanadium in the remaining slag melt from which a ferrovanadium alloy is further produced.

Another essential disadvantage of the prior art process resides in its insufficient productivity. This is due to the fact that melting of the slag and fluorspar on the hearth of an electric-arc furnace is effected at an insufficient speed which is explained by a low thermal conductivity of said mixture.

A long duration of the slag melting is also associated with the necessity of maintaining its temperature within the range of from 1,400° to 1,450° C. required for melting of the slag. To accelerate the melting process, it is necessary to increase temperature, but this usually results in reduction of vanadium in large quantities, which is undesirable since in turn, vanadium losses are increased. Furthermore, a complete reduction of iron and vanadium in the form of a ferrovanadium alloy by the addition of silicon and aluminium into an electric furnace is also a time-consuming operation, especially with decreasing vanadium content in the slag melt down to 1-2% by weight. This is due to inadequate agitation of the melt in an electric furnace (cf. USSR Inventor's Certificate No. 246552; Cl. C 21 c 7/00; 1969).

It is the main object of the present invention to provide a process for producing ferrovanadium alloys wherein a metal melt is subjected to operations which assure lowered losses of vanadium.

It is another important object of the present invention to provide such process for producing ferrovanadium alloys which provides increased productivity.

These objects are accomplished in a process for producing ferrovanadium alloys comprising melting of a charge containing iron and vanadium, followed by reducing iron and vanadium to obtain a metal melt, in accordance with the present invention, iron and vanadium are reduced substantially totally and the resulting metal melt is poured into a converter and purged through the converter bottom by means of oxygen blowing for a period and at such a rate of oxygen supply which assure production of a slag with a content of vanadium pentoxide of at least 35% by weight, whereafter the metal melt is poured out of the converter and vanadium and iron are reduced from the resulting slag in the form of a ferrovanadium alloy by the metallothermal method.

In the process according to the present invention losses of vanadium in the production of ferrovanadium alloys are considerably lowered.

This is achieved due to the fact that vanadium is completely reduced from the slag and then the metal melt is oxidized by means of oxygen blowing, thus lowering losses of vanadium both with the slag being drained and with the metal melt which is further used as scrap.

The process according to the present invention makes it possible to substantially increase productivity of the manufacture of ferrovanadium alloys owing to acceleration of reduction of vanadium and iron and lower losses of vanadium.

The above-mentioned and other features and advantages of the present invention will now become more fully apparent from the following detailed description of the process and Examples illustrating its embodiments.

The process for producing ferrovanadium alloys in accordance with the present invention is performed in the following manner.

As the starting material for the production of a ferrovanadium alloy use is made of a charge containing vanadium and iron; in the instant case as such charge use is made of a ferrovanadium slag. This slag is usually produced by purging a liquid vanadium-containing iron.

The thus-produced slag is charged into a converter and lime is added thereto. Afterwards, through tuyeres provided in the converter bottom, gas-oxygen blowing, i.e. simultaneous purging with oxygen and a gas (gaseous hydrocarbon in the instant case), is effected to melt the charge. In some cases melting of the charge is effected in an electric furnace or other melting units.

Thereafter, silicon is added into the converter in the form of ferrosilicium along with aluminium to completely reduce vanadium and iron from the slag.

During the addition of ferrosilicium and aluminium to the slag, a neutral-gas blowing is effected through the tuyeres provided in the converter bottom, i.e. the slag is purged with a neutral gas, in the instant case with steam, for a better agitation (intermixing) thereof for a period required for reduction of iron oxides and vanadium oxides. In other embodiments of the process according to the present invention the slag is purged with nitrogen or argon.

Then slag is poured out of the converter and the metal melt remains in the converter.

The metal melt is purged with oxygen through tuyeres provided in the converter bottom by means of oxygen blowing at such a supply rate of oxygen and for such a period of time which are sufficient to produce a slag with a content of vanadium pentoxide equal to 35% by weight.

As a result, about 0.1% of vanadium remains in the metal melt. Afterwards, the metal melt is discharged from the converter. Into the slag remaining in the converter with vanadium in the form of oxides, i.e. vanadium pentoxide, ferrosilicium and aluminium are added which, by reacting with oxygen, reduce vanadium from vanadium pentoxide. For agitation purposes use is made of a neutral-gas blowing which substantially improves agitation without, however, oxidizing the metals.

In some embodiments of the process according to the present invention steam blowing is used for agitation of the slag during the reduction of iron and vanadium instead of the neutral-gas blowing, since steam is a weak oxidizing agent.

EXAMPLE 1

Into a 10-ton converter with tuyeres for oxygen and neutral-gas blowing provided in the bottom there are charged 6 tons of a ferrovanadium slag with the content of vanadium pentoxide of 20% by weight and iron of 42% by weight, also in the form of oxides.

Then oxygen is blown through the tuyeres at the rate of 30 $m^3$/min and a gaseous hydrocarbon is also blown therethrough at the rate of 15 $m^3$/min. This results in melting of the slag in the converter. On expiration of 20 minutes of the oxygen blowing 550 kg of lump lime are charged into the converter. After 45 minutes of melting the slag is totally melted and the resulting melt is heated to the temperature of 1,500° C.

After melting the slag contains 17% by weight of vanadium pentoxide and 37% by weight of iron in the form of oxides.

The slag is then purged with steam at the rate of 12 $m^3$/min, with simultaneously blowing of a gaseous hydrocarbon therethrough at the rate of 4 $m^3$/min. During said blowing into the converter there are successively charged 550 kg of ferrosilicium containing 75% by weight of silicon (iron being the balance), 550 kg of lump lime, 1,150 kg of aluminium and again 550 kg of lump lime.

As a result, vanadium and iron are reduced from the slag; acceleration of the reduction process is achieved by means of steam blowing effected for 15 minutes. Thereafter, slag is discharged from the converter with the content of vanadium pentoxide of 0.42% by weight; the metal melt formed during the reduction contains 17.6% by weight of vanadium and 1% by weight of silicon is left in the converter.

The metal melt in the converter is purged for 20 minutes with oxygen at the rate of 35 $m^3$/min and a gaseous hydrocarbon at the rate of 3 $m^3$/min.

As a result of blowing through the metal melt there are obtained 2.2 tons of the slag containing vanadium pentoxide in the amount of 53% by weight and iron in the amount of 10% by weight in the form of oxides.

The resulting slag is left in the converter, while the metal melt with the content of vanadium of 0.12% by weight, that of carbon of 0.05% by weight (iron and impurities being the balance) is discharged and used for the manufacture of castings with the weight about 1.5 ton.

The slag remaining in the converter is subjected to reduction. During the reduction of the slag, steam blowing is effected at the rate of 12 $m^3$/min along with a gaseous hydrocarbon blown at the rate of 2 $m^3$/min. During the blowing 800 kg of lump aluminium and about 1 ton of lump lime are charged into the converter.

After the reduction there is obtained 1.4 ton of a ferrovanadium alloy with the content of vanadium of 43.4% by weight. The melt temperature at the end of the reduction process is as high as 1,700° C.

EXAMPLE 2

Into a 10-ton converter provided with tuyeres for oxygen and neutral-gas blowing in its bottom there are charged 1 ton of lime and 6 tons of a ferrovanadium slag with the content of vanadium pentoxide of 17.5% by weight and iron of 29% by weight which is contained in the form of oxides.

Then air is blown through the tuyeres at the rate of 40 $m^3$/min along with a gaseous hydrocarbon at the rate of 18 $m^3$/min. Afterwards, melting of the charge in the converter is started. After 35 minutes of melting, the whole of the charge is molten and the resulting melt is heated to the temperature of 1,500° C.

After melting the slag contains 14% by weight of vanadium pentoxide and 45% by weight of iron in the form of oxides. Then the slag is purged with steam at the rate of 15 $m^3$/min simultaneously with a gaseous hydrocarbon at the rate of 3 $m^3$/min. During the blowing 1,800 kg of ferrosilicium containing 75% by weight of silicon (iron being the balance) and then 100 kg of aluminium are charged into the converter.

As a result, vanadium and iron are reduced from the slag.

Steam blowing is performed for 10 minutes. Thereafter, the slag is discharged from the converter with the content of vanadium pentoxide of 0.5% by weight and the resulting metal melt with the content of vanadium of 15.2% by weight is left in the converter. The metal melt in the converter is blown for 20 minutes with oxygen at the rate of 35 $m^3$/min and with a gaseous hydrocarbon at the rate of 3 $m^3$/min.

As a result of blowing through the metal melt there are obtained 2.2 tons of a slag containing vanadium pentoxide in the amount of 42.5% and iron in the amount of 14% by weight in the form of oxides.

The resulting slag is left in the converter, while the metal melt with the content of vanadium of 0.21% by weight, carbon 0.04% by weight, manganese 0.06% by weight (iron and impurities being the balance) is discharged from the converter and used for the manufacture of castings with the weight of 2.4 tons.

The slag remaining in the converter is subjected to reduction. The reduction process in this case is effected by means of nitrogen blowing at the rate of 12 $m^3$/min along with gaseous-hydrocarbon blowing at the rate of 2 $m^3$/min. During the blowing 300 kg of ferrosilicium are charged into the converter with the content of silicon of 75% by weight (iron being the balance), 250 kg of lump aluminium and 500 kg of lime.

As a result of the reduction, there are obtained 1.1 ton of a ferrovanadium alloy with the content of vanadium of 42.5% by weight. The melt temperature at the end of reduction is 1,680° C.

EXAMPLE 3

Into a 10-ton converter with tuyeres provided in its bottom for oxygen and neutral-gas blowing there are charged 1 ton of lime and 7 tons of a ferrovanadium slag with the content of vanadium pentoxide of 15.2% by weight and that of iron of 26% by weight in the form of oxides.

Then oxygen is blown through the tuyeres at the rate of 35 $m^3$/min and gaseous hydrocarbon at the rate of 17 $m^3$/min. Thereafter, melting of the charge in the converter is started. After 40 minutes of melting, the whole of the charge is molten and the resulting melt is heated to the temperature of 1,500° C.

After melting the slag contains 12% by weight of vanadium pentoxide and 42% by weight of iron in the form of oxides.

Then the slag melt is purged with steam at the rate of 15 $m^3$/min simultaneously with a gaseous hydrocarbon blown at the rate of 3 $m^3$/min. During the blowing 1,000 kg of ferrosilicium containing 75% by weight of silicon (iron being the balance), 1,700 kg of ferrosilicium containing 45% by weight of silicon (iron being the balance) and then 1,000 kg of lump aluminium are charged into the converter.

As a result, vanadium and iron are reduced from the slag.

Steam blowing is effected for 15 minutes. Thereafter, the slag with the content of vanadium pentoxide of 0.53% by weight is discharged from the reactor, while the metal melt formed as a result of the reduction and containing 10.8% by weight of vanadium is left in the converter.

The metal melt in the converter is blown for 20 minutes with oxygen at the rate of 40 $m^3$/min and a gaseous hydrocarbon at the rate of 4 $m^3$/min. During the purging, 500 kg of lime are added into the converter.

As a result of said blowing through the metal melt there are obtained 2.3 tons of a slag containing vanadium pentoxide in the amount of 35% by weight and iron in the form of oxides in the amount of 22% by weight.

The resulting slag is left in the converter and the metal melt with the content of vanadium of 0.24% by weight, carbon 0.06% by weight (iron and impurities being the balance) is discharged from the reactor and used for the manufacture of a casting with the weight of 3.6 tons. During the reduction, steam blowing is effected with the rate of 15 $m^3$/min along with blowing of a gaseous hydrocarbon at the rate of 2 $m^3$/min for 12 minutes. During said blowing, 350 kg of ferrosilicium containing 75% by weight of silicon (iron being the balance) and 350 kg of lump aluminium are charged into the converter. As a result of the reduction there are obtained 1.3 ton of a ferrovanadium alloy with the content of vanadium of 36.1% by weight. The melt temperature at the end of the reduction process is as high as 1,720° C.

In the process according to the present invention, as it has been proven by experiments, productivity of the manufacture of ferrovanadium alloys is increased by approximately 25% and vanadium losses are lowered by approximately 4%.

Of course, persons skilled in the art may introduce various modifications in the process according to the present invention described hereinabove as an unlimiting illustrative example without, however, departing from the spirit and scope of the present invention.

What is claimed is:

1. Method of producing ferrovanadium alloys, which comprises melting a charge of ferrovanadium slag, which charge contains iron and vanadium, substantially completely reducing said iron and vanadium to form a metal melt, blowing oxygen into said metal melt in a converter bottom at a rate of supply of oxygen and for a period sufficient to obtain a slag with a content of vanadium pentoxide of at least 35% by weight and a remaining metal melt, discharging the thus remaining metal melt from the converter, and reducing the vanadium and iron in the remaining slag by metal-thermal reduction to form a ferrovanadium alloy.

* * * * *